United States Patent [19]

Adams

[11] 4,163,729

[45] * Aug. 7, 1979

[54] SYNERGISTIC COMBINATIONS OF HYDRATED POTASSIUM BORATE, ANTIWEAR AGENTS, AND ORGANIC SULFIDE ANTIOXIDANTS

[75] Inventor: John H. Adams, San Rafael, Calif.

[73] Assignee: Chevron Research Company, San Francisco, Calif.

[ * ] Notice: The portion of the term of this patent subsequent to May 16, 1995, has been disclaimed.

[21] Appl. No.: 891,415

[22] Filed: Mar. 29, 1978

Related U.S. Application Data

[63] Continuation-in-part of Ser. No. 636,386, Nov. 28, 1975, Pat. No. 4,089,790.

[51] Int. Cl.[2] ..... C10M 3/18; C10M 5/14; C10M 7/20; C10M 7/24

[52] U.S. Cl. ..... 252/18; 72/42; 252/25; 252/406

[58] Field of Search ..... 252/18, 25, 399, 406; 72/42

[56] References Cited

U.S. PATENT DOCUMENTS 4,089,790 5/1978 Adams ..... 252/18

*Primary Examiner*—Delbert E. Gantz
*Assistant Examiner*—Irving Vaughn
*Attorney, Agent, or Firm*—D. A. Newell; J. J. DeYoung

[57] ABSTRACT

A synergistic extreme-pressure lubricating composition comprising an oil of lubricating viscosity having dispersed therein: (1) 0.1–60 weight percent of hydrated potassium borate microparticles having a boron to potassium ratio of about 2.5 to 4.5, (2) from 0.01 to 5.0 weight percent of an antiwear agent selected from (a) a zinc dihydrocarbyl dithiophosphate having from 4 to 20 carbons in each hydrocarbyl group; (b) a $C_1$–$C_{20}$ amine salt of a dihydrocarbyl dithiophosphoric acid having from 4 to 20 carbons in each hydrocarbyl group; (c) a zinc alkyl aryl sulfonate; or (d) mixtures thereof, and (3) from 0.1 to 5 weight percent of an oil-soluble antioxidant organic sulfur compound containing from 3 to 40 weight percent sulfur, which sulfur is present as organic sulfide or polysulfide or mixtures thereof.

16 Claims, No Drawings

SYNERGISTIC COMBINATIONS OF HYDRATED POTASSIUM BORATE, ANTIWEAR AGENTS, AND ORGANIC SULFIDE ANTIOXIDANTS

CROSS-REFERENCE TO RELATED APPLICATION

This application is a continuation-in-part of application Ser. No. 636,386, filed Nov. 28, 1975 U.S. Pat. No. 4,089,790, the entire disclosure of which is incorporated herein by reference.

BACKGROUND OF THE INVENTION

This invention concerns extreme-pressure (EP) lubricating oil.

High-load conditions often occur in the gear sets used in automotive transmission differentials, pneumatic tools, gas compressors, high-pressure hydraulic systems, metal-working and similar devices as well as in many types of bearings. In order to avoid the undesirable effects which result when using an uncompounded oil under these high-load conditions, the lubricants for use in such service contain EP agents. For the most part, EP agents have been organic or metallo-organic compounds which are oil soluble or easily incorporated as a stable dispersion in the oil.

Recently, Peeler in U.S. Pat. No. 3,313,727 disclosed an EP lubricant produced by the dispersion in a nonpolar lubricating oil of an inorganic hydrated sodium or potassium borate. To prepare the lubricant, the borate, water and an emulsifier were introduced into the nonpolar medium. The mixture was then agitated to produce a microemulsion of the aqueous borate solution in the oil and thereafter heated to remove the liquid water. Peeler also disclosed that conventional additives such as rust inhibitors, foam inhibitors, etc., could be present in the finished lubricating composition containing the borate.

The borate-containing oils described by Peeler have, however, a very serious deficiency in service. If water is introduced into the system containing the borate lubricant, the borate crystallizes out of the oil and forms hard granules. These granules can cause severe noise in the system and in some cases damage the gears or bearings themselves. Further, loss of the borate by crystallization substantially decreases the EP function of the lubricant.

Although the borate dispersion prepared by Peeler has excellent extreme-pressure properties, it has been found that in sealed systems dispersions with high water content have an adverse effect on the seals. It is believed that the alkali metal borate dispersions slowly form solid deposits on shafts at or near the seals. The turning motion of the shafts then slowly abrades the seals, thereby allowing loss of lubricant. In addition, the borate dispersion described by Peeler exhibits a compatibility problem with conventional lubricating oil additives such as phenates, sulfurized fats and zinc dithiophosphate.

It is therefore an object of this invention to provide an extreme-pressure lubricant having improved antiwear properties and which is compatible with lubricating oil additives.

SUMMARY OF THE INVENTION

It has now been found that an improved extreme pressure lubricant can be obtained by the incorporation into a lubricating oil of a combination of (1) a particulate dispersion of a hydrated potassium borate having a mean particle size of less than 1 micron and a boron to potassium ratio of about 2.5 to 4.5; (2) an antiwear agent selected from (a) a zinc dihydrocarbyl dithiophosphate having from 4 to 20 carbon atoms in each hydrocarbyl group; (b) a $C_1$–$C_{20}$ ester, a $C_1$–$C_{20}$ amide or $C_1$–$C_{20}$ amine salt of a dihydrocarbyl dithiophosphoric acid having from 4 to 20 carbons in each hydrocarbyl group; (c) a zinc alkyl aryl sulfonate; or (d) mixtures thereof; and (3) from 0.1 to 5 weight percent of an oil-soluble organic sulfur compound containing from 3 to 40 weight percent sulfur, which sulfur is present within the compound as organic sulfide or polysulfide. This particular combination has been found to impart unexpectedly superior antiwear properties to the lubricant without substantially adversely affecting the excellent extreme-pressure properties, water tolerance and good seal properties imparted to the oil by the particulate borate dispersion.

DETAILED DESCRIPTION OF THE INVENTION

The compositions of this invention are stable EP lubricants. They perform well in standard EP tests such as the Timken Test and, particularly, the FZG Test. They are useful in numerous applications where extreme pressures are encountered and particularly as automotive differential lubricants. They have fluid or semifluid consistencies and many are transparent, a property which is highly advantageous where visual appearance is important or where it is desirable to be able to inspect the lubricated gears or bearings while they are in service. In most cases they are nontoxic and nonirritating to human skin.

There is provided in this invention an extreme-pressure lubricant comprising an oil of lubricating viscosity, from 0.1 to 60 weight percent of a hydrated potassium borate particulate dispersion having a boron to potassium ratio of about 2.5 to 4.5; from 0.01 to 5 weight percent of an antiwear agent selected from (a) a zinc dihydrocarbyl dithiophosphate having from 4 to 20 carbons in each hydrocarbyl group; (b) a $C_1$–$C_{20}$ ester, a $C_1$–$C_{20}$ amide, or $C_1$–$C_{20}$ amine salt of a dihydrocarbyl dithiophosphoric acid having from 4 to 20 carbon atoms in each hydrocarbyl group; (c) a zinc alkyl aryl sulfonate; or (d) mixtures thereof; and from 0.1 to 5% of an oil-soluble organic sulfur compound containing from 3 to 40 weight percent sulfur which sulfur is present within the compound as organic sulfide or polysulfide. Preferably the particles are dispersed in the oil with a dispersant consisting of an alkali or alkaline earth metal sulfonate and/or a succinimide.

PREPARATION OF THE POTASSIUM BORATE

The novel potassium borate dispersions of this invention are prepared by dehydrating a water-in-oil emulsion of an aqueous solution of potassium hydroxide and boric acid to provide a boron to potassium ratio of 2.5 to 4.5. The method is carried out by introducing into the inert nonpolar oil medium an aqueous solution of potassium hydroxide and boric acid (potassium borate solution) and preferably an emulsifier, vigorously agitating the mixture to provide an emulsion of the aqueous solution in the oil and then heating at a temperature and for a time which provide the desired degree of hydration of the microemulsion.

The hydrated borates of this invention will contain up to 5 water of hydration, usually 0.5 to 5.0, and preferably 1.0 to 5.0. For practical reasons, the minimum amount of water of hydration will be about 0.01 mol per mol of $B_2O_3$. It is possible to obtain an anhydrous alkali metal borate, but it requires an unnecessarily large degree of processing to do so. Further, exposure of the anhydrous material to ambient air will result in the natural accumulation of some water of hydration.

The temperature at which the emulsion is heated will generally be at least 100° C. and more usually at least 120° C. Temperatures of up to 260° C. may be used, although it is preferred that the temperature not exceed 180° C. Lower temperatures may be used at reduced pressures. However, the process is conveniently carried out at atmospheric pressures and at temperatures in the range described.

The time of the reaction will depend upon the degree of dehydration, the amount of water present and the temperature. Time is not critical, and will be determined for the most part by the variables mentioned. The water initially present will be sufficient to dissolve the potassium borate, but should not be in such excess as to make dehydration difficult.

The potassium borate dispersion may be prepared by an alternative method. In this method a potassium carbonate overbased oil-soluble alkali or alkaline earth metal sulfonate is reacted with boric acid to form a potassium borate reaction product. The amount of boric acid reacted with the potassium carbonate should be sufficient to prepare a potassium borate having a boron to potassium ratio of at least 5. This potassium borate is converted to the potassium borate of this invention by contacting the intermediate borate reaction product with a sufficient amount of potassium hydroxide to prepare the potassium borate having a boron to potassium ratio between 2.5 and 4.5. The water content may be adjusted by adding water or by dehydrating the product in the manner described earlier.

The borate particles are almost entirely less than one micron in size and for the most part less than 0.5 micron in size. The product may be filtered to remove the larger microparticles.

The reaction of the potassium carbonate-overbased metal sulfonate with boric acid and a subsequent reaction with potassium hydroxide may be conducted at a reaction temperature of 20° to 200° C. and preferably from 20° to 150° C. A reaction diluent may be present during the two reaction stages and subsequently removed by conventional stripping steps.

The antiwear agent for use in this invention, i.e., the dithiophosphate or sulfonate additive, is present at a concentration of 0.01 to 5.0 weight percent, preferably 0.1 to 2 weight percent, and more preferably from 0.25 to 0.5 weight percent. The weight ratio of antiwear agent to particulate potassium borate will usually be between about 0.005 and 10, preferably between about 0.05 and 1, and more preferably between 0.05 and 0.1. The dihydrocarbyl dithiophosphoric acid-derived antiwear agent is a zinc or amine salt, or an ester or amide thereof. It is formed by reacting the dihydrocarbyl dithiophosphoric acid with (1) a zinc base, (2) a $C_1$–$C_{20}$ alcohol or olefin, or (3) a $C_1$–$C_{20}$ amine. The amide is formed by reacting the dithiophosphoric acid with the amine at elevated temperatures and the amine salt is formed when the dithiophosphoric acid is contacted with the amine at lower temperatures. It is recognized that the amide and the amine salt may be present simultaneously.

The hydrocarbyl portion of the dithiophosphoric acid will usually have from 4 to 20 carbons, preferably from 5 to 12 carbons, and more preferably from 6 to 8 carbons. As referred to herein, the term "hydrocarbyl" represents a monovalent organic radical composed essentially of hydrogen and carbon, but minor amounts of inert substituents may be present. The hydrocarbyl may be aliphatic, aromatic or alicyclic or combinations thereof, for example, aralkyl, alkyl, aryl, cycloalkyl, alkylcycloalkyl, etc., and may be saturated or olefinically unsaturated. Exemplary hydrocarbyl groups include methyl, ethyl, propyl, butyl, pentyl, 4-methylpentyl, 2-ethylhexyl, hexyl, octyl, isooctyl, stearyl, phenyl, benzyl, ethylbenzyl, amyl, propenylphenyl, dipropenylphenyl, tetrapropenylphenyl, tolyl, etc. The primary, secondary or tertiary hydrocarbyl groups may be employed, but the branched-chain, primary groups are preferred.

The ester, amide or amine salt portion of the dithiophosphate will generally have from 1 to 20 carbons, preferably 4 to 10 carbons, and from 0 to 5 nitrogens (when the amide or amine salt is employed, that portion preferably has from 1 to 3 nitrogens with the carbon to nitrogen atomic ratio preferably ranging from 1 to 10). The ester, amide or amide salt portion of the dihydrocarbyl dithiophosphate antiwear agent will contain stable organic moieties such as hydrocarbon or ethoxylated hydrocarbon groups.

Exemplary zinc dihydrocarbyl dithiophosphates include zinc di-n-octyl dithiophosphate, zinc butyl isooctyl dithiophosphate, zinc di-4-methyl-2-pentyl dithiophosphate, zinc ditetrapropenylphenyl dithiophosphate, zinc di-2-ethyl-1-hexyl dithiophosphate, zinc diisoctyl dithiophosphate, zinc dihexyl dithiophosphate, zinc diphenyl dithiophosphate, zinc diethylphenyl dithiophosphate, zinc diamyl dithiophosphate, zinc butyl phenyl dithiophosphate, zinc dioctadecyl dithiophosphate.

Exemplary dihydrocarbyl dithiophosphate amides include the ethyl amide of di-4-methyl-2-pentyl dithiophosphate, the butyl amide of diisoctyl dithiophosphate, the aminoethyl amide of ditetrapropenylphenyl dithiophosphate, the diamino diethylene amide of ditetrapropenylphenyl dithiophosphate, and diamino diethylene amide of di-2-ethyl-1-hexyl dithiophosphate.

The aminoethyl amide is prepared by reacting ethylene diamine with a corresponding dihydrocarbyl dithiophosphoric acid. Similarly, the diamino diethylene amide is prepared by reacting diethylene triamine with a corresponding dihydrocarbyl dithiophosphoric acid. Exemplary dihydrocarbyl dithiophosphate amine salts include the butyl amine salt of di-2-ethyl-1-hexyl dithiophosphate, the pentyl amine salt of diisoctyl dithiophosphate, the diethylene triamine salt of ditetrapropenylphenyl dithiophosphate and the ethylene diamine salt of di-4-methyl-2-pentyl dithiophosphate.

The zinc sulfonates contemplated for use as an antiwear agent in the composition of this invention are zinc salts of petroleum sulfonates and alkyl aryl sulfonates. The aryl portion is phenyl or naphthyl. The alkyl portion may be any primary, secondary or tertiary alkyl group of from 6 to 32 carbon atoms. Preferred alkyl groups are primary alkyl groups of from 9 to 27 carbon atoms. Exemplary zinc sulfonates falling within the scope of this invention are zinc dinonyl naphthalene sulfonate, and the zinc salt of the reaction product of alpha-olefin and tetrapropylphenol, such as zinc 2-octadecyl 4-tetrapropylphenyl sulfonate.

The preferred antiwear agents are prepared from dialkyl dithiophosphoric acid and preferably the alkyl groups have sterically hindered $C_1$–$C_3$ branches. Exemplary sterically hindered alkyls include 2-ethyl-1-hexyl, 4-methyl-2-pentyl, etc.

The antioxidant organic sulfur compound for use in this invention, i.e., the sulfide or polysulfide additive, is present in a concentration of 0.1 to 5 weight percent, preferably 0.5 to 2 weight percent, and more preferably from 0.75 to 1.5 weight percent. The weight ratio of the organic sulfur antioxidant to the particulate potassium borate will usually be between 0.02 and 2, preferably between about 0.1 and 0.8, and more preferably between about 0.15 and 0.60.

The antioxidant sulfur compounds which may be employed in the practice of this invention include a wide range of compounds containing from 3 to 40 weight percent sulfur which is present within the compound as organic sulfide and polysulfide. The presence of sulfur in other forms such as sulfinates, sulfates, etc., may exist within the compounds, but is not included in the calculating of the sulfur content of the organic sulfur compound. Preferred sulfur-containing antioxidants are those prepared by sulfurizing a chlorinated wax. The compound may contain elements other than carbon, hydrogen and sulfur without adversely affecting the properties of the composition and include elements such as oxygen which may be present as ether, ketone, carboxyl, ester, alcohol, etc.; phosphorus; nitrogen present as amine, amide, imide, etc.; as well as metal such as alkali metals, alkaline earth metals, etc., and halogen such as chlorine.

One class of organic sulfur compounds which may be employed herein is sulfurized olefins such as $C_8$–$C_{30}$ mono- and polyethenically unsaturated aliphatic hydrocarbons, aromatic and alkyl sulfides such as dibenzyl sulfide, dixylyl disulfide, dicetyl sulfide. Di-paraffin wax sulfide and polysulfide may also be employed. Paraffin wax thiomers as described in U.S. Pat. No. 2,346,156 are also suitable.

Another class of organic sulfur compounds which may be employed in the practice of this invention includes sulfurized olefins prepared by the reaction of a $C_3$–$C_6$ olefin, or a low-molecular-weight polyolefin derived therefrom, with a sulfur-containing compound such as sulfur monochloride, sulfur dichloride, etc.

Another class of organic sulfur compounds which may be employed herein is sulfurized fatty esters. These compounds are prepared by contacting sulfur with an unsaturated fatty ester under elevated temperature. Typical esters include $C_1$–$C_{20}$ alkyl esters of $C_8$–$C_{24}$ unsaturated fatty acids such as palmitoleic, oleic, ricinoleic, petroselinic, vaccenic, linoleic, linolenic, oleostearic, licanic, etc. Particularly good results have been obtained with mixed unsaturated fatty acid esters such as are obtained from animal fats and vegetable oils such as tall oil, linseed oil, olive oil, castor oil, peanut oil, rape oil, fish oil, sperm oil, etc.

Exemplary fatty esters include lauryl tallate, methyl oleate, ethyl oleate, lauryl oleate, cetyl oleate, cetyl lineolate, lauryl ricinoleate, oleyl linoleate, oleyl stearate, etc. These compounds can be phosphosulfurized by contacting the fatty esters with phosphorus pentasulfide along with the sulfur to produce a sulfurized, phosphosulfurized ester.

Cross-sulfurized ester olefins such as a sulfurized mixture of $C_{10}$–$C_{25}$ olefins with fatty acid esters of $C_{10}$–$C_{25}$ fatty acids and $C_1$–$C_{25}$ alkyl or alkenyl alcohols wherein the fatty acid and/or the alcohol is unsaturated may also be employed in this invention.

Another class of organic sulfur-containing compounds which may be used in the practice of this invention is sulfurized aliphatic esters of an olefinic mono- or di-carboxylic acid, for example an aliphatic alcohol of 1 to 30 carbon atoms used to esterify monocarboxylic acids such as acrylic acid, methacrylic acid, 2,4-pentadienoic acid, and the like; or fumaric acid, maleic acid, muconic acid, and the like. Sulfurization is carried out by combining the above-described esters with elemental sulfur, sulfur monochloride or sulfur dichloride.

Another class of organic sulfur compounds which may be employed in this invention includes sulfurized terpenes such as sulfurized pine oil, sulfurized terpinolene, sulfurized dipentene, sulfurized pinene, etc. Another class of sulfide compounds which may be advantageously employed in the process of this invention comprises the polyalkyl phenol sulfides. These compounds have the general structural formula:

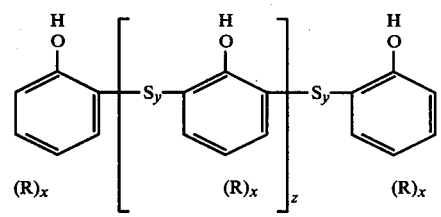

wherein R is an alkyl having from 5 to 24 carbons; x is an integer from 1 to 3; y is an integer from 1 to 5; and z is an integer from 0 to 5.

Compounds having the above formula are prepared by contacting an alkylated phenol with sulfur mono- or dichloride in the proper proportions under elevated temperatures. These compounds can be thereafter reacted with phosphorus pentoxide, an alkali or alkaline earth metal base or an amine.

The Lubricating Oil

The oil medium in which the borate antiwear agent and organic sulfur compound is dispersed can be any fluid of low dielectric constant which is inert under the reaction conditions (particularly nonsaponifiable) and of lubricating viscosity. Fluids of lubricating viscosity generally have viscosities of from 35 to 50,000 Saybolt Universal Seconds (SUS) at 100° F. (38° C.). The fluid medium or oil may be derived from either natural or synthetic sources. Included among the natural hydrocarbonaceous oils are paraffin base, naphthenic base and mixed base oils. Synthetic oils include polymers of various olefins (generally from 2 to 6 carbon atoms), alkylated aromatic hydrocarbons, etc. Nonhydrocarbon oils include polyalkylene oxides such as polyethylene oxide, aromatic ethers, silicone, etc. The preferred media are the hydrocarbonaceous oils, both natural and synthetic. Prefered among the hydrocarbonaceous oils are those having SAE viscosity numbers of 5W to 20W and 20 to 250, and especially those having SAE viscosity numbers in the range 75 to 250.

The lubricating oil content of the composition will depend on the concentrations of the other components, for the lubricating oil constitutes the balance of the composition after the concentrations of the borate, the antiwear agents and the organic sulfur compounds and any other desired additives have been specified. Ordinarily, the oil concentration will range from 65 to about 98 weight percent, preferably 80 to about 95 weight percent, in the working composition and from about 10 to about 65 weight percent in the concentrate.

Compositions preferably contain a dispersant, either non-ionic or anionic. The non-ionic dispersants include, for example, the hydrocarbyl polyamines, mono and dialkyl alkenylsuccinates, polyamine alkenylsuccinimides, etc. The anionic dispersants include for example, the alkali metal and alkaline earth metal salts of hydrocarbyl sulfonates, alkyl phenates, alkyl phosphates, etc.

The compositions of this invention preferably contain an alkali or alkaline earth metal sulfonate dispersant, and more preferably the compositions contain both a metal sulfonate dispersant and a sccinimide dispersant. The ratio of sulfonate to succinimide is a factor in achieving the proper water tolerance properties of the borate lubricant. The sulfonate dispersant is an alkali or alkaline earth metal salt of a hydrocarbyl sulfonic acid having from 15 to 200 carbons. Preferably the term "sulfonate" encompasses the salts of sulfonic acid derived from petroleum products. Such acids are well known in the art. They can be obtained by treating petroleum products with sulfuric acid or sulfur trioxide. The acids thus obtained are known as petroleum sulfonic acids and the salts as petroleum sulfonates. Most of the compounds in the petroleum products which become sulfonated contain an oil-solubilizing hydrocarbon group. Also included within the meaning of "sulfonate" are the salts of sulfonic acids of synthetic alkyl aryl compounds. These acids also are prepared by treating an alkyl aryl compound with sulfuric acid or sulfur trioxide. At least one alkyl substituent of the aryl ring is an oil-solubilizing group, as discussed above. The acids thus obtained are known as alkyl aryl sulfonic acids and the salts as alkyl aryl sulfonates. The sulfonates where the alkyl is straight-chain are the well-known linear alkylaryl sulfonates.

The acids obtained by sulfonation are converted to the metal salts by neutralizing with a basic reacting alkali or alkaline earth metal compound to yield the Group I or Group II metal sulfonates. Generally, the acids are neutralized with an alkali metal base. Alkaline earth metal salts ae obtained from the alkali metal salt by metathesis. Alternatively, the sulfonic acids can be neutralized directly with an alkaline earth metal base. The sulfonates can then be overbased, although, for purposes of this invention, overbasing is not necessary. Overbased materials and methods of preparing such materials are well known to those skilled in the art. See, for example, LeSuer U.S. Pat. No. 3,496,105, issued Feb. 17, 1970, particularly Cols. 3 and 4.

The sulfonates are present in the lubricating oil composition in the form of alkali and/or alkaline earth metal salts, or mixtures thereof. The alkali metals include lithium, sodium and potassium. The alkaline earth metals include magnesium, calcium and barium, of which the latter two are preferred.

Particularly preferred, however, because of their wide availability, are salts of the petroleum sulfonic acids, particularly the petroleum sulfonic acids which are obtained by sulfonating various hydrocarbon fractions such as lubricating oil fractions and extracts rich in aromatics which are obtained by extracting a hydrocarbon oil with a selective solvent, which extracts may, if desired, be alkylated before sulfonation by reacting them with olefins or alkyl chlorides by means of an alkylation catalyst; organic polysulfonic acids such as benzene disulfonic acid which may or may not be alkylated; and the like.

The preferred salts for use in the present invention are those of alkylated aromatic sulfonic acids in which the alkyl radical or radicals contain at least about 8 carbon atoms, for example from about 8 to about 22 carbon atoms. Exemplary members of this preferred group of sulfonate starting materials are the aliphatic-substituted cyclic sulfonic acids in which the aliphatic substituent or substituents contain a total of at least 12 carbon atoms, such as the alkyl aryl sulfonic acids, alkyl cycloaliphatic sulfonic acids, and alkyl heterocyclic sulfonic acids and aliphatic sulfonic acids in which the aliphatic radical or radicals contain a total of at least 12 carbon atoms. Specific examples of these oil-soluble sulfonic acids include petroleum sulfonic acid, petrolatum sulfonic acids, mono- and poly-wax-substituted naphthalene sulfonic acids, substituted sulfonic acids, such as cetyl benzene sulfonic acids, cetyl phenyl sulfonic acids, and the like, aliphatic sulfonic acid, such as paraffin wax sulfonic acids, hydroxy-substituted paraffin was sulfonic acids, etc., cycloaliphatic sulfonic acids, petroleum naphthalene sulfonic acids, cetyl cyclopentyl sulfonic acid, mono- and poly-wax-substituted cyclohexyl sulfonic acids, and the like. The term "petroleum sulfonic acids" is intended to cover all sulfonic acids which are derived directly from petroleum products.

Typical Group II metal sulfonates suitable for use in this composition include the metal sulfonates exemplified as follows: calcium white oil benzene sulfonate, barium white oil benzene sulfonate, magnesium white oil benzene sulfonate, calcium dipolypropene benzene sulfonate, barium dipolypropene benzene sulfonate, magnesium dipolypropene benzene sulfonate, calcium mahogany petroleum sulfonate, barium mahogany petroleum sulfonate, magnesium mahogany petroleum sulfonate, calcium triacontyl sulfonate, magnesium triacontyl sulfonate, calcium lauryl sulfonate, barium lauryl sulfonate, magnesium lauryl sulfonate, etc. The concentration of metal sulfonate which may be employed may vary over a wide range, depending upon the concentration of potassium borate particles. Generally, however, the concentration may range from 0.2 to about 5 weight percent and preferably from 0.3 to 3 weight percent.

In the most preferred embodiment of this invention, from 0.01 to 2 weight percent and preferably from 0.1 to 2 weight percent of a sccinimide dispersant is also present in the borate-containing lubricating compositions. These succinimides are usually derived from the reaction of alkenyl succinic acid or anhydride and alkylene polyamines. These compounds are generally considered to have the formula

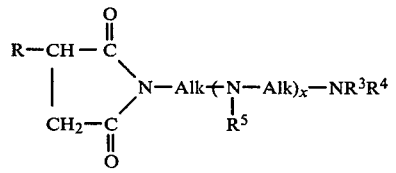

wherein R is a substantially hydrocarbon radical having a molecular weight from about 400 to 3000, that is, R is a hydrocarbyl radical containing about 30 to about 200 carbon atoms; Alk is an alkylene radical of 2 to 10, preferably 2 to 6, carbon atoms, $R^3$, $R^4$ and $R^5$ are selected from a $C_1$–$C_4$ alkyl or alkoxy or hydrogen, preferably hydrogen, and x is an integer from 0 to 6, preferably 0 to 3. The actual reaction product of alkylene succinic acid or anhydride and alkylene polyamine will comprise the mixture of compounds including succinamic acids and succinimides. However, it is customary to designate this reaction product as succinimide of the described formula, since this will be a principal component of the mixture. See U.S. Pat. Nos. 3,202,678, 3,024,237 and 3,172,892.

These N-substituted alkenyl succinimides can be prepared by reacting maleic anhydride with an olefinic hydrocarbon followed by reacting the resulting alkenyl succinic anhydride with the alkylene polyamine. The R radical of the above formula, that is, the alkenyl radical, is preferably derived from an olefin containing from 2 to 5 carbon atoms. Thus, the alkenyl radical is obtained by polymerizing an olefin containing from 2 to 5 carbon atoms to form a hydrocarbon having a molecular weight ranging from about 400 to 3000. Such olefins are exemplified by ethylene, propylene, 1-butene, 2-butene, isobutene, and mixtures thereof.

The preferred polyalkylene amines used to prepare the succinimides are of the formula

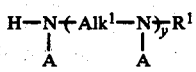

wherein y is an integer from 1 to 10, preferably 1 to 6, A and $R^1$ are each a substantially hydrocarbon or hydrogen radical, and alkylene radical $Alk^1$ is preferably a lower alkylene radical having less than about 8 carbon atoms. The alkylene amines include principally methylene amines, ethylene amines, butylene amines, propylene amines, pentylene amines, hexylene amines, heptylene amines, octylene amines, other polymethylene amines and also the cyclic and the higher homologs of such amines as piperazine and amino alkyl-substituted piperazines. They are exemplified specifically by ethylene diamine, triethylene tetraamine, propylene diamine, decamethyl diamine, octamethylene diamine, diheptamethylene triamine, tripropylene tetraamine, tetraethylene pentamine, trimethylene diamine, pentaethylene hexamine, ditrimethylene triamine, 2-heptyl-3-(2-aminopropyl)imidazoline, 4-methyl imidazoline, N,N-dimethyl-1,3-propane diamine, 1,3-bis(2-aminoethyl-)imidazoline, 1-(2-aminopropyl)piperazine, 1,4-bis(2-aminoethyl)piperazine and 2-methyl-1-(2-aminobutyl)-piperazine. Higher homologs such as are obtained by condensing two or more of the above-illustrated alkylene amines likewise are useful.

The ethylene amines are especially useful. They are described in some detail under the heading "Ethylene Amines" in *Encyclopedia of Chemical Technology,* Kirk-Othmer, Vol. 5, pp. 898–905 (Interscience Publishers, New York, 1950).

The term "ethylene amine" is used in a generic sense to denote a class of polyamines conforming for the most part to the structure

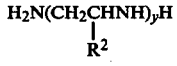

in which $R^2$ is a lower alkyl radical of 1 to 4 carbon atoms or hydrogen and y is as defined above. Thus, it includes, for example, ethylene diamine, diethylene triamine, triethylene tetraamine, tetraethylene pentamine, pentaethylene hexamine, 1,2-diamiopropane, N,N-di(1-methyl-2-aminomethyl)amine, etc.

The mixture of metal sulfonate dispersant and succinimide surface-active dispersant will generally be present in an amount from 0.25 to 5 weight percent, more usually from 0.5 to 3 weight percent, of the composition. The actual amount of dispersant mixture will vary with the particular mixture used and the total amount of borate in the oil. Generally about 0.05 to 0.5, more usually about 0.1 to 0.3 parts by weight, of mixture will be used per part by weight of the potassium borate (in the concentrates, the concentration of each component in the mixture will be based on the relationship to potassium borate rather than on the fixed percentage limits of the lubricant as noted above). Generally, the upper ranges of the dispersant mixture concentration will be used with the upper ranges of the potassium borate concentration.

Trihydrocarbyl Phosphates

When the antiwear agent is a zinc alkyl aryl sulfonate, from 0 to 1 weight percent of a phosphate as defined below may be present, preferably from 0 to 0.25 weight percent.

The phosphate has the general formula:

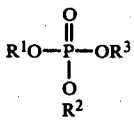

wherein each of $R^1$, $R^2$ and $R^3$ is independently an aliphatic or aromatic group, the total molecular weight of $R^1$, $R^2$ and $R^3$ being high enough to avoid volatilization of phosphate at high temperatures. Preferably the total number of carbon atoms in the groups $R^1$, $R^2$ and $R^3$ is at least 18 and less than 35. Particularly preferred phosphates falling within the scope of this invention are tricresyl phosphate and tris(2-ethylhexyl) phosphate, which enhance the functioning of the borate composition by reducing wear.

Additives

Other materials may also be present as additives in the composition of this invention. Such materials may be added for enhancing some of the properties which are imparted to the lubricating medium by the potassium borate while providing other desirable properties to the lubricating medium. These include additives such as rust inhibitors, antioxidants, oiliness agents, foam inhibitors, viscosity index improvers, pour point depressants, etc. Usually these will be in the range from about 0.1 to 5 weight percent, preferably in the range from about 0.1 to 2 weight percent, of the total composition. An antifoaming agent may also be added with advantage. The amount required will generally be about 0.5 to 50 ppm, based on the total composition.

EXAMPLES

EXAMPLE 1

A glass flask is charged with 102 g of a 126 neutral petroleum oil, 36 g of a neutral calcium petroleum sulfonate (prepared by sulfonating a 480 neutral oil and neutralizing the sulfonic acid with sodium hydroxide followed by metathesis with calcium chloride to form the calcium sulfonate), containing about 1.7% calcium and 12 g of polyisobutenylsuccinimide dispersant (prepared by reacting polyisobutenyl succinic anhydride with tetraethylene pentamine). The contents of the flask are mixed and thereafter a mixture of 100 ml of water containing 120 g of potassium borate (formed by reacting 66 g of 86% pure potassium hydroxide with 124 g of boric acid) are charged to the flask. The contents are vigorously agitated to form a stable microemulsion of the aqueous phase within the oil medium. The emulsion is dehydrated at a temperature of 135° C. to yield 278 g of product. This corresponds to approximately 2.5 waters of hydration left in the potassium borate particles. The particulate borate composition is calculated to have the empirical formula:

$K_2O2B_2O_32.5H_2O$

In the above and following examples, the water of hydration was determined by infrared analysis. The IR absorption at 3400 $cm^{-1}$ was measured for a sample in a 0.2 mm cell. The sample contained 5 grams of the borate and 95 grams of a CITCON oil. The absorption of the sample was compared with a standard curve absorption for percent water.

EXAMPLE 2

This example illustrates the preparation of a potassium triborate dispersion. A glass flask is charged with 102 g of 126 neutral petroleum oil, 36 g of a neutral calcium sulfonate dispersant of the type disclosed in Example 1, and 12 g of a succinimide dispersant of the type disclosed in Example 1. The contents of the flask are mixed, and thereafter a mixture of 200 ml of water containing 119 g of potassium borate (formed by reacting 52 g of 86% pure potassium hydroxide with 145 g of boric acid) are charged to the flask. The contents are vigorously agitated to form a stable microemulsion of the aqueous phase within the petroleum oil. The emulsion is dehydrated at a temperature of 132° C. to yield 286 g of product. Infrared analysis showed 8% water in the emulsion. This corresponds to approximately 3.2 waters of hydration left in the potassium borate particles. The particulate borate composition is calculated to have the empirical formula:

$K_2O3B_2O_33.2H_2O$

EXAMPLE 3

The procedure of Example 2 is repeated except that 18 g of the neutral calcium sulfonate described in Example 1 and 30 g of the succinimide described in Example 1 are used.

EXAMPLE 4

The procedure of Example 3 is repeated except that 108 g of neutral oil and 12 g of the calcium sulfonate are used.

EXAMPLE 5

The procedure of Example 2 is repeated except that 104 g of potassium borate (formed by reacting 40 g of 86% pure potassim hydroxide and 152 g of boric acid are charged to the flask along with 300 ml of water. The flask contents are dehydrated to yield about 274 g of product. The particulate borate composition is calculated to have the approximate empirical formula:

$K_2O4B_2O_33.6H_2O$

EXAMPLE 6

A glass flask is charged with 102 g of 130 neutral petroleum oil, 36 g of a neutral calcium petroleum sulfonate of the type disclosed in Example 1 and 12 g of a polyisobutenyl succinimide of the type described in Example 1. The contents of the flask are mixed and thereafter a mixture of 100 ml of water containing 245 g of sodium metaborate is charged to the flask. The contents are vigorously agitated to form a stable microemulsion of the aqueous phase within the oil medium. The emulsion is dehydrated at a temperature of about 135° C. to yield 300 g of product. The particulate borate composition is calculated to have the approximate empirical formula:

$Na_2OB_2O_32H_2O$

EXAMPLE 7

The procedure of Example 2 is repeated except on a larger scale. A kettle is charged with 5628 g of 130 neutral petroleum oil, 974 L g of a neutral calcium petroleum sulfonate of the type disclosed in Example 1, and 1817 g of polyisobutenyl succinimide of the type described in Example 1. The contents of the flask are mixed and thereafter a mixture of 12,500 ml of water containing 2870 g of 86% pure potassium hydroxide and 8000 g boric acid is charged to the flask. The contents are vigorously agitated by a Manton-Gaulin Mill to form a stable microemulsion of the aqueous phase within the oil medium. The emulsion is dehydrated at a temperature of 129° C. to yield 11,120 g of product. Infrared analysis shows 5% water in the emulsion. This corresponds to approximately 2.0 waters of hydration left in the potassium borate particles. The particulate borate is calculated to have the empirical formula:

$K_2O3B_2O_32H_2O$

EXAMPLE 8

10% of the dispersion prepared by the method of Example 7 is blended in SAE 90 hydrocarbon oil to which is added 1.5% water. The mixture is agitated until all of the water is taken up by the borate particles. Infrared analysis shows 1.6% water in the finished oil. This corresponds to 7.0 waters of hydration in the potassium borate particles. The particulate dispersion is calculated to have the empirical formula:

$K_2O3B_2O_37H_2O$

EXAMPLE 9

This example is presented to illustrate the various performance properties of the borate-containing compositions. A series of tests is performed with each sample composition to measure the extreme-pressure properties (Timken E.P. Test), the antiwear properties (4-Ball Wear Test), the compatibility properties (Compatibility Test) and the seal leakage properties (Seal Leakage Test). The Timken Test is described in ASTM D-2782-69T, which test procedure is herein incorporated by reference. The 4-Ball Wear Test is described in ASTM D-2873-69T, which test procedure is also herein incorporated by reference. The Compatibility Test is conducted by admixing with each weight part of a lube oil containing 5% of a metal borate, one weight part of a lube oil containing 3 to 5 weight percent of a conventional sulfurized ester additive containing about 10% sulfur. The admixture is placed in an oven at 149° C. for 24 hours. After this period, if a stable gel of 5% to 100% of the mixture has formed, the compatibility is rated as "Fail". If a light gel or sediment representing less than 5% of the mixture or no deposits have formed, the compatibility is rated as "Pass". The seal leakage test is conducted by charging a sample of the test oil to a seal leakage apparatus and measuring the amount of oil leakage over a 48-hour period. The seal leakage apparatus is comprised of a sealed chamber with a shaft passing through and journalled to the chamber. Seals are provided at each end of the chamber encompassing the shaft so as to prevent oil from within the chamber from leaking along the shaft to outside collection cylinders. The shaft is turned at 3600 rpm and the oil within the chamber is maintained at atmospheric pressure and at a temperature of about 57° C. A test oil which has less than 10 ml of oil leakage over a 48-hour period with no deposit on the shaft is noted as "Good". A test oil having a leakage of 10 to 30 ml of oil over a 48-hour period with light deposit is rated as "Moderate". A test oil which has more than 40 ml of oil leakage and a heavy deposit over 48 hours is noted as "Poor".

The water-tolerance properties of the sample oils are determined by either of two comparable tests. In the first test, water is added to an oil containing 5 weight percent borate solids until the water content is 10%. The mixture is then heated up to 110° C. until only 2% water remains in the oil. The partially dehydrated solution is checked daily for quantity and hardness of any deposits. Those samples having several hard deposits are rated poor, while those having few or no deposits are rated good. In the second test, a modification of Coordinating Research Counsel L-33 is used. In this test, 2.5 pints of test lubricant are placed in a bench-mounted automotive differential assembly and water added. The differential assembly is then turned while heating and subsequently subjected to additional heat without turning. In the modification of the test used herein, water in an amount of about 250 cc (rather than 28.3 cc) is added and the differential assembly is turned continuously during heating. The same rating of poor and good is employed in this test. Since both of the tests produce comparable results for the purposes of this invention, there is no designation in the table below of the particular test used to derive the data for each one.

The antiwear characteristics of the composition are determined by using the composition as the test lubricant in the well-known "Four-Ball" test. This test is described in Boner, pages 222–224. In the test, three ½" steel balls of the type commonly used in ball bearings are placed in a steel cup and clamped in fixed position. A fourth ball of the same type is held rigidly on the end of a shaft which rotates about a vertical axis. The balls are immersed in the test lubricant and the fourth ball is forced against the other three under a measured load. The fourth ball is then rotated at a designated speed for a fixed period. At the end of this period, the wear scar diameters on the three fixed balls are measured and averaged, and the average scar size reported as the result of the test. The smaller the wear scar, the better the EP characteristics of the test lubricant. In order to be considered a satisfactory EP lubricant, the lubricant must not have a Four-Ball scar of greater than 0.6 mm, and preferably not greater than 0.5 mm.

A group of 8 oil samples is tested. The oil samples correspond to the borate-containing lubricant disclosed in the preceding 8 examples. Thus, test sample 1 is the lubricant of Example 1, test sample 2 is the lubricant of Example 2, etc. Each of the oil samples is subjected to the above tests and the data from these tests are reported in Table I.

TABLE I

PROPERTIES OF BORATE DISPERSIONS

| Example No. | Concentration, wt. % | Borate | Timken Load (Pass, lbs.) | 4-Ball Wear,* mm | Seal Leakage | Compatability | Water Tolerance |
|---|---|---|---|---|---|---|---|
| 1 | 10 | $K_2O \cdot 2B_2O_3 \cdot 2.5H_2O$ | 100 | 0.439 | — | Fail | — |
| 2 | 10 | $K_2O \cdot 3B_2O_3 \cdot 3.2H_2O$ | 100 | 0.54 | Good | Pass | Poor |
| 3 | 19 | $K_2O \cdot 3B_2O_3 \cdot 3.2H_2O$ | 100 | 0.61 | Good | Pass | Good |
| 4 | 10 | $K_2O \cdot 3B_2O_3 \cdot 3.2H_2O$ | 100 | 0.71 | Good | Pass | Good |
| 5 | 10 | $K_2O \cdot 4B_2O_3 \cdot 3.6H_2O$ | 60 | 0.60 | — | Pass | — |
| 6 | 10 | $Na_2O \cdot B_2O_3 \cdot 2.0H_2O$ | 100 | 0.39 | Poor | Fail | Good |
| 7 | 10 | $K_2O \cdot 3B_2O_3 \cdot 2.0H_2O$ | 40 | — | — | — | Good |
| 8 | 10 | $K_2O \cdot 3B_2O_3 \cdot 7.0H_2O$ | 100 | — | Poor | Pass | Good |

*50-kg applied weight, 30-minute operating time and 1730 rpm

EXAMPLE 10

This example is presented to illustrate the improved performance properties of the three-component system described herein as compared to the borate-containing composition alone or to the combination of the borate and the antiwear agent.

A. Table II below illustrates the performance characteristics of representative compositions measured by the Timken EP test described in Example 9, which illustrates the extreme-pressure properties of each composition.

B. Table III below illustrates the antiwear properties of the three-component system of this invention as compared to the antiwear properties of the various components alone and in a variety of combinations. The antiwear properties are tested by means of the Four-Ball Wear Test as described in Example 9.

C. Table IV below illustrates the results of the Gear Oil Oxidation Test for the compositions of this invention as well as for the components making up the compositions of the invention. The Gear Oil Oxidation Test is carried out by bubbling oxygen through the test oil at 250° F. in the presence of iron and copper coils using the same equipment as in ASTM D-943. A passing result is an oil showing less than 100% viscosity increase (210° F.) in 1000 hours.

D. Table V below illustrates the effectiveness of the synergistic composition of this invention in the FZG Gear Test. This FZG test measures the antiscuffing properties of oil for reduction gears, hypoid gears, automatic transmission gears and the like. A description of the FZG test and the meaning of the results is found in the article "Scuffing Tests on Gear Oils in the FZG Apparatus" by G. Niemann, H. Rettig and G. Lechner in ASLE Transactions, 4 71–86 (1961).

EXAMPLE 11

A kettle was charged with 1325 pounds of water, 680 pounds of 50% potassium hydroxide and 1070 pounds of boric acid. The final mixture was heated at 180°–190° F. In a separate vessel a solution was prepared from 130.5 pounds of a neutral calcium petroleum sulfonate of the type described in Example 1, 267.5 pounds of a polyisobutenyl succinimide of the type described in Example 1, and 1174 pounds of a 130 neutral oil. The solution was heated to 170° F. The contents of this vessel and the hot aqueous borate solution were mixed and passed through a Manton-Gaulin Mill to form a stable microemulsion of aqueous phase in the oil medium.

The resulting emulsion was continuously passed through the mill and through a stirred reactor. In the reactor, hot air was passed over the surface of the liquid to effect dehydration. While being circulated, the temperature of the emulsion was raised from 180° F. to 250° F. over a period of 9 hours. The vaporized water was removed from the system with the hot air. Aliquots of the emulsion were removed periodically and analyzed for water content by the previously described infrared method. Three hours after reaching 250° F., the water content was 2 weight percent which corresponds to an empirical formula:

$$K_2O\ 3B_2O_3\ 1H_2O$$

Then, the circulating emulsion was slowly cooled to room temperature and stored in barrels to give 2275 pounds of product.

TABLE II

TIMKEN EP TEST

| Borate | Antiwear Agent | Antioxidant | Other Additives | Timken Load pass, lbs. |
|---|---|---|---|---|
| 10% composition of Ex. 7 | | | | 100 |
| | 0.5% Zn di(2-ethylhexyl)dithiophosphate | | | 30 |
| 10% composition of Ex. 7 | 0.5% Zn di(2-ethylhexyl)dithiophosphate | | | 100 |
| 10% composition of Ex. 7 | | 1% sulfurized diparaffin polysulfide | | 100 |
| 10% composition of Ex. 7 | 0.5% Zn di(2-ethylhexyl)dithiophosphate | 1% sulfurized diparaffin polysulfide | | 70–100 |
| 10% composition of Ex. 7 | 0.25% Zn di(2-ethylhexyl)dithiophosphate | 0.5% sulfurized polybutene | 0.5% 4,4-methylene bis-(2,6-di-t-butyl) phenol | 100 |
| 7.5% composition of Ex. 7 | 0.25% Zn di(2-ethylhexyl)dithiophosphate | 1% sulfurized diparaffin polysulfide | 0.5% 4,4-methylene bis-(2,6-di-t-butyl) phenol | 90 |
| 5.0% composition of Ex. 7 | 0.25% Zn di(2-ethylhexyl)dithiophosphate | 1% sulfurized diparaffin polysulfide | 0.5% 4,4-methylene bis-(2,6-di-t-butyl) phenol | 85, 55 |
| 10% composition of Ex. 7 | 0.25% Zn di(2-ethylhexyl)dithiophosphate | 1% sulfurized paraffin polysulfide | 0.5% 4,4-methylene bis-(2,6-di-t-butyl) phenol | 100 |
| 5% composition of Ex. 7 | 0.25% Zn di(2-ethylhexyl)dithiophosphate | 1% sulfurized diparaffin polysulfide | 0.5% 4,4-methylene bis-(2,6-di-t-butyl) phenol | 45 |
| 10% composition of Ex. 7 | 0.75% Zn di(2-ethylhexyl)dithiophosphate | 1% sulfurized diparaffin polysulfide | 0.5% 4,4-methylene bis-(2,6-di-t-butyl) phenol | 75 |

TABLE III

4-BALL WEAR TEST

| Borate | Antiwear Agent | Antioxidant | Other Additives | Scar, mm |
|---|---|---|---|---|
| 10% composition of Ex. 7 | | | | 0.60 |
| 10% composition of Ex. 7 | 0.5% Zn di(2-ethylhexyl) dithiophosphate | | | 0.40 |
| 10% composition of Ex. 7 | 0.2% Zn di(2-ethylhexyl) dithiophosphate | | | 0.42 |
| 10% composition of Ex. 7 | 0.1% Zn di(2-ethylhexyl) dithiophosphate | | | 0.50 |
| 10% composition of Ex. 7 | 1% Zn dinonyl naphthalene sulfonate | | | 0.63, 0.59 |
| 10% composition of Ex. 7 | | 1% sulfurized polyisobutylene | | 0.60 |
| 10% composition of Ex. 7 | 1% Zn dinonyl naphthalene sulfonate | 1% sulfurized polyisobutylene | | 0.45, 0.47 |
| 10% composition of Ex. 7 | 0.5% Zn dinonyl naphthalene sulfonate | 1% sulfurized polyisobutylene | | 0.58 |
| 10% composition of Ex. 7 | 0.75% Zn dinonyl naphthalene sulfonate | 0.5% sulfurized diparaffin polysulfide | | 0.61 |
| 5% $K_2O$ . $3B_2O_3$ . $2H_2O$ | 0.7% Zn dinonyl naphthalene sulfonate | 1% sulfurized polyisobutylene | 1.6% polyisobutenyl succinimide | 0.51 |
| 10% of Ex. 7 | 1% Zn alkylaryl sulfonate | 1% sulfurized polyisobutylene | | 0.54 |
| 10% of Ex. 7 | 1% Zn alkylaryl sulfonate | 1% sulfurized polyisobutylene | 1% tricresyl phosphate | 0.43 |

TABLE III-continued

4-BALL WEAR TEST

| Borate | Antiwear Agent | Antioxidant | Other Additives | Scar, mm |
|---|---|---|---|---|
| 10% of Ex. 7 | 1.25% Zn alkylaryl sulfonate | 1% sulfurized polyisobutylene | 0.25% tricresyl phosphate | 0.44 |
| 5% $K_2O \cdot 3B_2O_3 \cdot 2H_2O$ | 0.7% Zn dinonyl naphthylene sulfonate | 1% sulfurized polyisobutylene | 1.1% pentaerythritol ester of polyisobutylene succinic anhydride | 0.53 |

TABLE IV

GEAR OIL OXIDATION TEST

| 0.5% 4,4-methylene bis-(2,6-di-t-butyl) phenol | 10% composition of Ex. 7 | 0.5% Zn di(2-ethylhexyl)dithiophosphate | 1% Sulfurized diparaffin polysulfide | Result |
|---|---|---|---|---|
| X | X | | | Fail |
| X | X | X | | Fail |
| X | X | | X | Fail |
| X | X | X | X | Pass |

TABLE V

FZG TEST (Type A Gears, 16.6 meters/sec, 90° C.)

| 10% composition of Ex. 7 | Zn di(2-ethylhexyl)-dithiophosphate | Antioxidant | * | Stage Pass | Mg weight loss after 13th stage |
|---|---|---|---|---|---|
| X | | | | 9 | |
| X | 0.5% | | | 11 | |
| X | | 1% sulfurized diparaffin polysulfide | | 8 | |
| X | X | X | X | 13+ | 8 |
| X | 0.25% | 0.5% sulfurized polybutene | X | 12 | 26 |
| X | 0.5% | 3% sulfurized fatty acid ester | X | 12 | 143 |

*0.5% Ethyl 728 (4,4'-methylene bis(2,6-di-t-butylphenol)

What is claimed is:

1. A lubricating oil composition containing dispersed therein (1) from 0.1 to 60 weight percent of a particulate hydrated potassium borate having a mean particle size less than 1 micron and having a boron-to-potassium ratio of 2.5 to 4.5 and containing from 0.01 to 5 waters of hydration, (2) from 0.01 to 5 weight percent of an antiwear agent selected from (a) a zinc dihydrocarbyl dithiophosphate having from 4 to 20 carbons in each hydrocarbyl group, (b) a $C_1$ to $C_{20}$ ester, $C_1$ to $C_{20}$ amide, or $C_1$ to $C_{20}$ amine salt of a dihydrocarbyl dithiophosphoric acid having from 4 to 20 carbons in each hydrocarbyl group, (c) a zinc alkyl aryl sulfonate; and (d) mixtures thereof, and (3) from 0.1 to 5 weight percent of an oil-soluble antioxidant organic sulfur compound containing from 3 to 40 weight percent sulfur, which sulfur is present as an organic sulfide or polysulfide or mixtures thereof.

2. The lubricating oil composition of claim 1 containing from 2.5 to 25 weight percent, based on the weight of the composition, of a particulate hydrated potassium borate having a mean particle size less than 1 micron and having a boron-to-potassium ratio of 2.5 to 4.5, and containing from 1 to 5 waters of hydration.

3. The lubricating oil composition of claim 2 wherein from 0.1 to 2 weight percent of said antiwear agent is present and from 0.25 to 3 of said antioxidant is present.

4. The lubricating oil composition of claim 3 wherein said antiwear agent is a zinc dihydrocarbyl dithiophosphate having from 5 to 12 carbon atoms in each hydrocarbyl group.

5. The lubricating oil composition of claim 3 wherein said antiwear agent is zinc dinonylnaphthylene sulfonate.

6. The lubricating oil composition of claim 3 wherein said antioxidant is sulfurized polybutene or sulfurized diparaffin polysulfide.

7. The lubricating oil composition of claim 1 wherein the hydrated potassium borate microparticles are dispersed by an oil-soluble alkali or alkaline earth metal sulfonate.

8. The lubricating oil composition of claim 1 wherein the potassium borate is dispersed in a combination of an oil-soluble alkali or alkaline earth metal sulfonate and an alkenyl succinimide dispersant.

9. The lubricating oil composition of claim 8 wherein said alkali or alkaline earth metal sulfonate dispersant is a calcium petroleum sulfonate.

10. The lubricating oil composition of claim 9 wherein said alkenyl succinimide dispersant is a polyisobutenyl succinimide prepared by reacting polyisobutenyl succinic anhydride with tetraethylene pentamine.

11. The lubricating oil composition of claim 10 wherein said antiwear agent is a zinc dihydrocarbyl dithiophosphate and said antioxidant is sulfurized polybutene or sulfurized diparaffin polysulfide.

12. The lubricating oil composition of claim 11 wherein said zinc dihydrocarbyl dithiophosphate is a zinc dialkyl dithiophosphate wherein the alkyl groups are sterically hindered.

13. In the method for lubricating a device wherein two metallic moving parts are separated by a lubricant, the improvement comprising using as the lubricant a lubricating oil composition according to claim 1.

14. A method for preparing a lubricant having improved extreme-pressure properties, which comprises admixing with an oil base of lubricating viscosity: (1) from 0.1 to 60 weight percent of a particulate hydrated potassium borate having a mean particle size less than one micron and having a boron to potassium ratio of 2.5 to 4.5 and containing 0.01 to 5 waters of hydration; (2) from 0.01 to 5 weight percent of an antiwear agent selected from (a) zinc dihydrocarbyl dithiophosphate having from 4 to 20 carbons in each hydrocarbyl group, (b) a $C_1$–$C_{20}$ ester, a $C_1$–$C_{20}$ amide, or $C_1$–$C_{20}$ amine salt of a dihydrocarbyl dithiophosphoric acid having from 4 to 20 carbons in each hydrocarbyl group, (c) a zinc alkyl aryl sulfonate, and (d) mixtures thereof; and (3) from 0.1 to 5 weight percent of an oil-soluble antioxidant organic sulfur compound containing from 3 to 40 weight percent sulfur, which sulfur is present as an organic sulfide or polysulfide or mixtures thereof.

15. The composition of claims 1, 3, or 11 wherein said hydrated potassium borate contains 0.5 to 5.0 waters of hydration.

16. The method of claims 13 or 14 wherein said hydrated potassium borate contains 0.5 to 5.0 waters of hydration.

* * * * *